United States Patent [19]

Bock

[11] 4,130,058

[45] Dec. 19, 1978

[54] FASTENING BAR FOR SECURING PRINTING PLATES ON A PRINTING MACHINE

[76] Inventor: Erich Bock, Dürener Str. 5, 4600 Dortmund 1, Germany

[21] Appl. No.: 770,230

[22] Filed: Feb. 18, 1977

[30] Foreign Application Priority Data

Feb. 19, 1976 [DE] Fed. Rep. of Germany ..... 2606773

[51] Int. Cl.[2] ..... B41F 27/06

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,237,557 | 3/1966 | Worthington et al. | 101/415.1 |
| 3,335,667 | 8/1967 | Harenza | 101/415.1 |
| 3,359,899 | 12/1967 | Luehrs | 101/415.1 |
| 3,456,588 | 7/1969 | Brodie | 101/415.1 |
| 3,536,003 | 10/1967 | Oderman | 101/415.1 |
| 3,557,695 | 1/1971 | Preuss | 101/415.1 |
| 3,752,075 | 8/1973 | Fusco | 101/415.1 |

FOREIGN PATENT DOCUMENTS

| | | | |
|---|---|---|---|
| 2060001 | 6/1972 | Fed. Rep. of Germany | 101/415.1 |

*Primary Examiner*—William Pieprz
*Attorney, Agent, or Firm*—Karl F. Ross

[57] ABSTRACT

A fastening bar for securing printing plates to a printing machine, especially a rotary printing press, comprises a base and a clamping bar fastened thereto, the clamping and release of the printing plate being effected by an eccentric shaft. In the base one or more clamping elements are displaceably mounted and have ends juxtaposed with the opposing clamping surface of the clamping bar, the opposite ends bearing against springs which permit compensation for different thickness along the edge of the printing plate.

15 Claims, 14 Drawing Figures

FASTENING BAR FOR SECURING PRINTING PLATES ON A PRINTING MACHINE

FIELD OF THE INVENTION

The present invention relates to a securing device for fastening printing plates on a printing press and, more particularly, to improved clamping means engageable with the edge of a printing plate for securing same to the cylinder of a rotary printing press.

BACKGROUND OF THE INVENTION

In rotary printing presses and other printing machines it is desirable to provide means engageable with an edge of the printing plate for securing same, by clamping, to the rotary printing drum or another portion of the press. It has already been proposed to provide such clamping means for actuation by an eccentric shaft.

In prior art systems for securing the printing plate on a printing machine, use has been made of so-called "quick-acting fastening bars" which can include a base to which a clamping bar is fixed by screws. The fastening screws permit a given swingability of the clamping bar with respect to the base, actuated by rotation of an eccentric shaft between the engaged and disengaged (locking and release) portions. The disadvantage of this conventional quick acting clamp arrangement is that it is effective only when the printing plate is of uniform thickness along the clamped edge or when it is adjusted accurately to compensate for varying thicknesses therealong. In the event such adjustment is imprecise or the printing plate has nonuniform thickness along the edge to be clamped, which is a common occurrence, the printing plate is not held firmly all along the clamped edge and a nonuniform stress is applied to the printing plate or the latter is held too loosely.

OBJECT OF THE INVENTION

It is the principal object of the invention to provide a clamping arrangement for the edge of a printing plate, especially for the cylinder of a rotary printing press, in which the aforedescribed disadvantages are avoided and which enables a rapid and simple engagement of the printing plate with an automatic pressure equalization so that a completely uniform clamping of the printing plate is ensured.

SUMMARY OF THE INVENTION

This object and others which will become apparent hereinafter are attained, in accordance with the present invention, in a fastening arrangement for securing an edge of a printing plate to a support, especially to a drum of a rotary printing press, which comprises an elongated fastening bar having an elongated base, a clamping bar fastened to this base, a plurality of clamped elements spaced apart along the base and displaceable relatively thereto and means including an eccentric shaft for simultaneously displacing the clamping members toward the clamping bar to secure an edge of the printing plate between the clamp elements on the one hand and the clamping bar on the other.

According to this invention, one end of each of the clamping elements is juxtaposed with the clamping bar and is adapted to press the clamped edge thereagainst while the opposite end of each clamping element is acted upon by a spring means which enables a yieldable engagement of each clamping element with the printing plate. The yieldable arrangement of the clamping elements permits a completely uniform pressure distribution along the edge of the printing plate during engagement so that the printing plate is uniformly secured over its entire width.

According to a feature of the invention, the base is subdivided into a multiplicity of base members which are each connected to a respective clamping-bar member, the individual unit, consisting of clamping bar member and base member, being provided along a common eccentric shaft so that a common edge of the printing plate can be engaged by the individual clamps formed by the respective units, all of which are controlled by a common eccentric shaft. This permits the locking of the printing plate to be effected in an unusually simple manner by means of a single locking lever connected to the eccentric shaft preferably at the approximate center thereof. This arrangement naturally results in a minimum locking up time and reduces the number of manipulations required for locking up the printing plate even if the latter has varying thickness along its clamped edge.

According to another feature of the invention, between the base and the clamping bar there are provided a plurality of springs which bias the clamping elements away from the clamping bar, i.e. into the release position so that these springs can automatically produce a gap between the juxtaposed faces of the clamping elements and the clamping bar when the eccentric shaft is swung into its release position, thereby facilitating and speeding the withdrawal and insertion of the edge of the printing plate.

In one highly advantageous embodiment of the invention, the clamping bar is mounted upon the base (which in turn can be fixed or adjustably positioned on the printing drum or cylinder) by means of threaded bolts whose shanks are provided with spacers which are received in recesses of the clamping bar. The screws are so arranged or positioned that they do not cause a tilting of the clamping bar. The recesses in the clamping are dimensioned so that their boundaries (walls) lie immediately adjacent the spacers in both end positions of the clamping bar. In this manner, the adjustment movements of the clamping bar along the bolts is permitted without causing the bolts to abut the clamping bar.

According to another feature of the invention, the clamping elements receive threaded bolts or the like whose heads lie in recesses of the base. The depth of the recesses of the base is selected such that, in the clamped position the end of the screw or bolt remote from the clamping surfaces lies flush with a face of the base, i.e. the underside thereof, while in the released position, the head of the bolt rests against the bottom of the recess. In the latter position, the opposite end of the clamping element may project above the top of the base, being pressed downwardly during the clamping operation. The depth of the recess thus determines the degree of displacement of the clamping element.

According to another feature of the invention, the spring bearing upon the clamping element, to which the afore-mentioned bolt is threaded, is seated against an inwardly projecting portion of the base above the wall of the recess which limits the upward movement of the clamping element by engagement with the head of the screw. Thus the extent to which the screw is threaded into the clamping element permits adjustment of the prestress upon the spring. Advantageously, the spring comprises a stack of dished-disk (Belleville) washers which can surround the shank of the screw and form a guide for the latter which prevents tilting of the screw in the base.

According to still another feature of the invention, the base for the clamping bar can each be provided with a recess or cutout, the latter forming together the passage through which the eccentric shaft extends.

Still another feature of the invention, in another advantageous embodiment, provides that the base and clamping bar are fixed relative to one another by threaded bolts or screws. The clamping elements can then be slidably mounted in the base and can comprise a pin having a flanged free and/or a free end provided with a plate with which the eccentric shaft can cooperate. The flange or plate can form a set for the spring which can surround the pin and bar upon the upper portions of the clamping elements with respect to which the pin is slidable. The stiffness of the spring is so dimensioned that, upon rotation of the eccentric shaft, it is compressed to a certain extent to urge the body of the clamping element in the direction of the overhanging portion of the clamping bar with a simultaneous relative displacement of the pin and the body. The rigid connection of the base and the clamping bar thus permits a gap to be maintained between the two into which the printing plate can be inserted, for the springs bearing upon the afore-mentioned bodies urge them into their retracted position when the eccentric shaft is rotated into its "release" position.

Advantageously the springs surrounding the pin are dished-disk springs or Belleville washers whose number and dimensions can be selected to provide the desired degree of relative displacement of the pin and the body.

To prevent undesired release of the clamping arrangement, the lever which displaces the clamping elements can be indexed in its extreme positions or in at least one of these extreme positions, namely, the "locking" or "engage" position.

BRIEF DESCRIPTION OF THE DRAWING

The above and other objects, features and advantages of the present invention will become more readily apparent from the following description, reference being made to the accompanying drawing in which.

SPECIFIC DESCRIPTION

In the embodiment of FIGS. 1 through 8, the base of the device is designated at 1 and the clamping bar at 2. In this embodiment the clamping bar 2 is the movable member which, upon rotation of an eccentric shaft 3 locks or releases the edge of a printing plate (not shown). In the embodiment of FIGS. 9 through 14, however, the movable member is the individual clamping elements which are spaced along the base.

Figure 1:
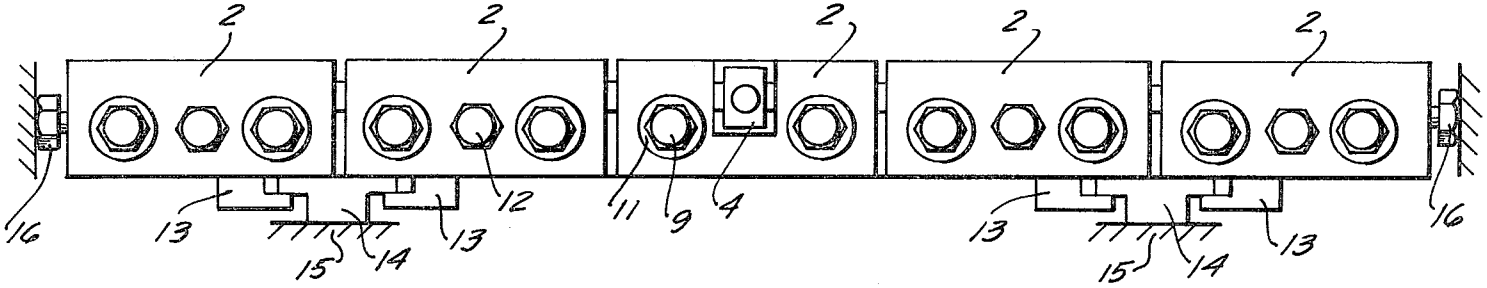
FIG. 1 is an elevational view of a clamping arrangement according to the invention from the side at which the screws holding the same together are seen.
Figure 2:
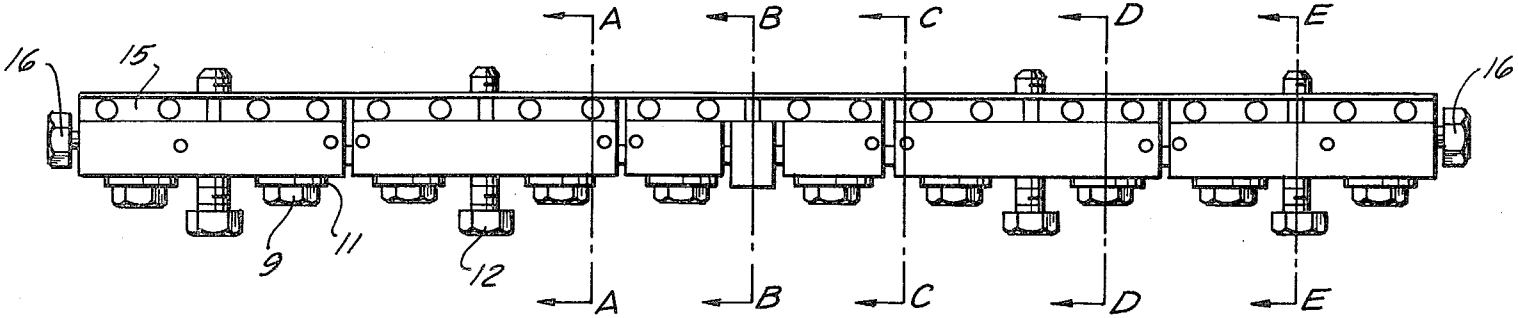
FIG. 2 is a plan view of the embodiment of FIG. 1.
Figure 4:
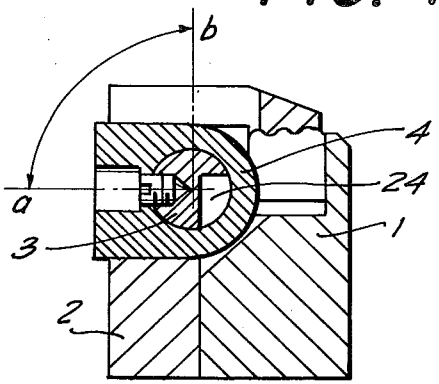
FIG. 4 is a section taken along the line B—B of FIG. 2.

Reverting to FIGS. 1 through 8 and, particularly FIGS. 1 and 2, it will be apparent that the arrangement illustrated in the drawing comprises a plurality of clamping units 1, 2 disposed in line and adjacent one another upon a common eccentric shaft 3 to which the actuating lever 4 is secured (see FIG. 4). The lever 4 can be swung from the locking position a into the release position b to effect an angular displacement of the eccentric shaft through 90° as is clear from this FIG. The number of units 1, 2 can be selected at will and is determined by the width of the printing press.

The entire clamping arrangement is fixed by its guides 14 engaged by the brackets 13 with the cylinder 15 of the printing press in the usual manner. Adjusting screws 16 laterally position the clamping arrangement in the axial direction of the eccentric shaft, i.e. longitudinally with respect to the units 1, 2.

Figure 8:
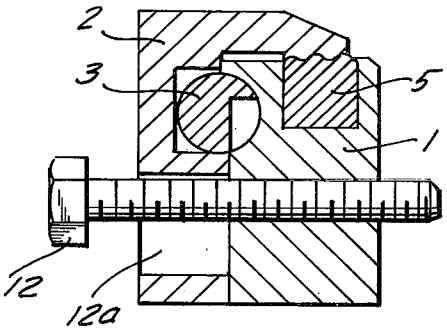
FIG. 8 is a section along the line E—E of FIG. 2.

As FIG. 8 shows, throughgoing screws 12 are threaded into the base 1 of each unit to permit radial adjustment of the units. The screws 12 pass through cutouts 12*a* in the clamping bars 2 so that the clamping bars are freely movable relative to the screws 12 into the upper and lower extreme positions of these clamping bars (compare FIGS. 3 and 5). Such movement is effected without the edges, boundaries or walls of the cutouts 12*a* engaging the shanks of the screws 12.

As can be seen especially from the simultaneous views of FIGS. 3 through 8, each of the bases 1 of the fastening device is provided with a clamping element 5 which is vertically shiftable in a slot 23 which opens upwardly toward a clamping face 29 of the clamping bar 2 overhanging this slot. The free end of each clamping element 5 is thus juxtaposed with the face 29 which forms one of the clamping jaws of the device. The elements 5 form the opposing jaw.

Screws 7 are threaded into each clamping element 5 from below and have heads 19 lying in downwardly open recesses 20 of a depth so dimensioned that, in the clamping position (see FIG. 5) the bottom of the head 19 of each screw 7 lies flush with the underside of the base 1. In the release position (FIG. 3) the head 19 of each bolt 7 lies against the floor 21 of the recess 20. The shanks of the screws 7 are surrounded by a stack of dished-disk spring washers (Belleville washers) forming a compression spring 6. The compression spring 6 is seated upon the top of an inwardly projecting flange 22 and against the underside of the clamping element 5. The screws 7 thus permit the prestress (precompression) of the spring 6 to be adjusted precisely.

Figure 5:
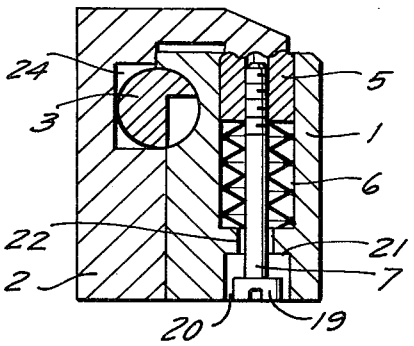
FIG. 5 is a section taken along the line A—A of FIG. 2 but showing the device in the clamped state.

The base 1 and the clamping bar 2 are each provided with a recess open in the direction of the other and forming the space 24 in which the common eccentric shaft 3 is rotatable (see FIG. 5).

As can be seen from FIG. 4, rotation of the eccentric shaft 3 by the lever 4 in a single pivotal movement from the position b to the position a simultaneously displaced each of the clamping bars 2 downwardly to lock all of the units and clamp the printing plate uniformly between the bodies.

Upon swinging of the actuating lever 4 into the release position b (FIG. 4), thereby raising the clamping bars 2 relative to the base 1 (FIG. 3), the clamping elements 5 are urged upwardly by the springs 6 but are restrained by the heads 19 of the screws 7 so that a gap remains between the elements 5 and the clamping jaw 29 to accommodate the printing plate. The restoring force urging the clamping bars 2 upwardly is provided by springs 8 which bear upon the clamping bars 2 (see FIG. 6) and are seated against the respective base 1.

Figure 7:
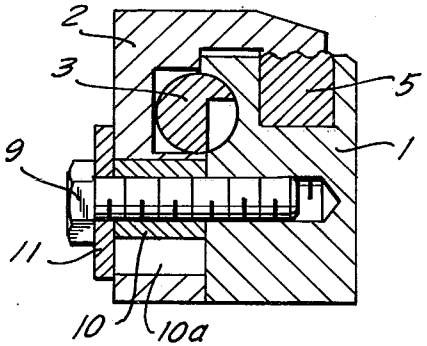
FIG. 7 is a section along a section along the line D—D of FIG. 2.
Figure 6:
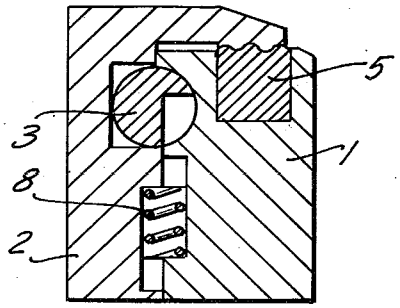
FIG. 6 is a section taken along the line C—C of FIG. 2.
Figure 9:
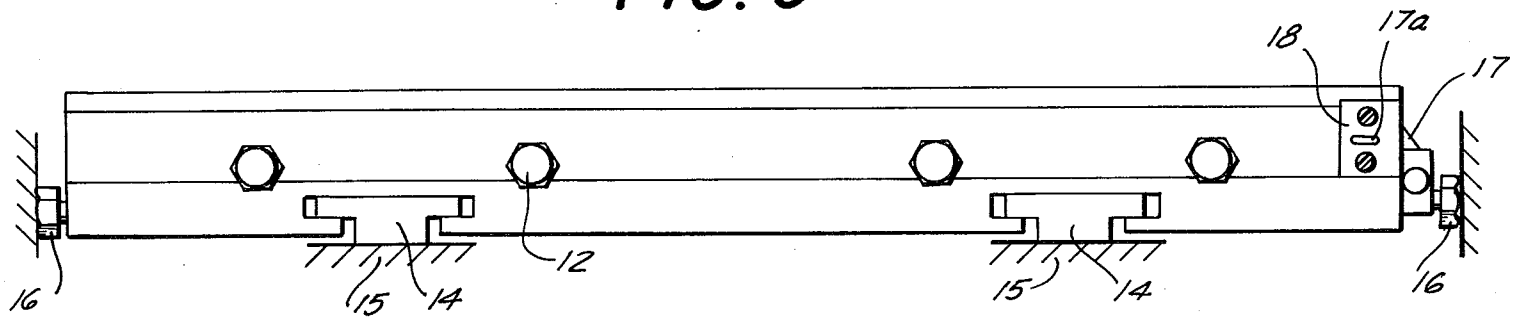
FIG. 9 is an elevational view of another embodiment of the invention in which the clamping bar is fixed to the base.

As can be seen from FIG. 7, each clamping bar 2 is guided along the fixed base 1 by a guided washer 11 which is locked by a screw 9 against a spacer sleeve 10. The screws 9 are threaded into the bases 1. Each clamping bar 2 is formed with an opening 10*a* in which the sleeve 10 is received with clearance to allow the displacement of the bar 2 between its limiting positions. The openings 10*a* are so dimensioned that the opposite ends of these openings can engage the sleeve 10 in these limiting positions.

Figure 3:
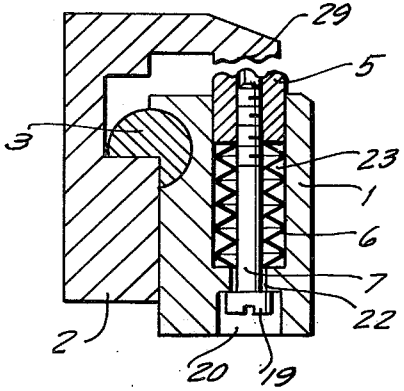
FIG. 3 is a section taken along the line A—A of FIG. 2 showing the released position of the clamping elements.

The operation of the embodiment of FIGS. 1–8 is as follows:

Orginally the clamping units are in the position shown in FIG. 3, the lever 4 being in the b position (FIG. 4) and a gap provided between the jaw 29 and the clamping elements 5.

The printing plate is inserted into this gap and the lever 4 is swung in the counterclockwise sense (FIG. 4) into the position illustrated at a, thereby rotating the eccentric shaft 3 and shifting each of the clamping bars 2 downwardly (arrow in FIG. 3) into the position shown in FIGS. 5–8. The clamping action presses the printing plate against the elements 5, thereby compressing the springs 6 to a degree which is determined by thickness variations in the printing plate. The springs 8 are thereby simultaneously compressed.

To release the printing plate, the lever 4 is rotated in the clockwise sense into the position b, whereupon the springs 8 urge the clamping bars 2 downwardly into the position shown in FIG. 3 to reform the gap and enable withdrawal of the printing plate. Simultaneously, the springs 6 expand.

Figure 10:
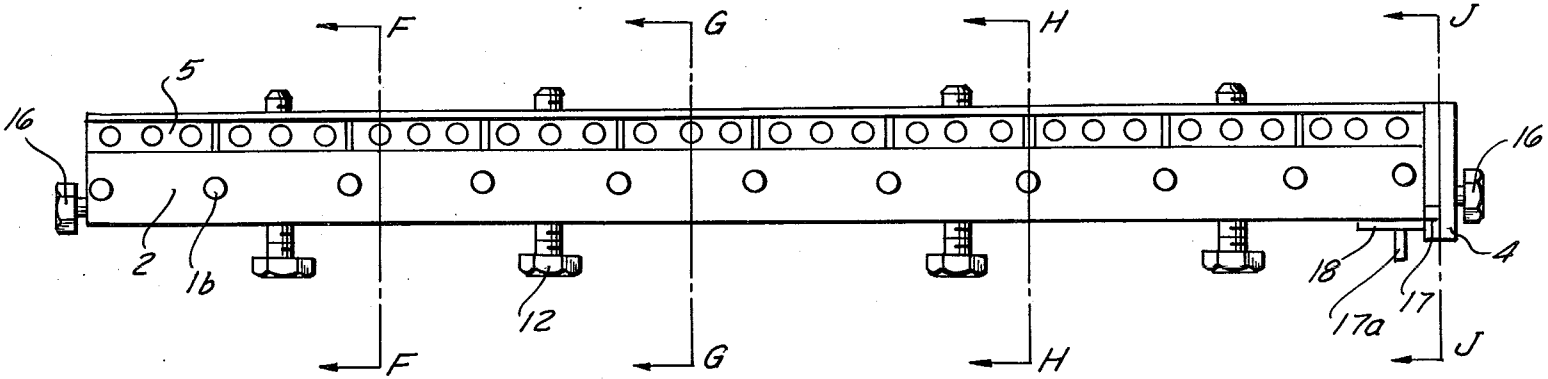
FIG. 10 is a plan view of the clamping arrangement of FIG. 9.
Figure 11:
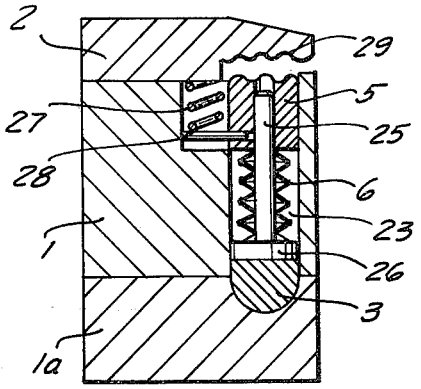
FIG. 11 is a section along the line F—F of FIG. 10 in the locked state of the device.
Figure 12:
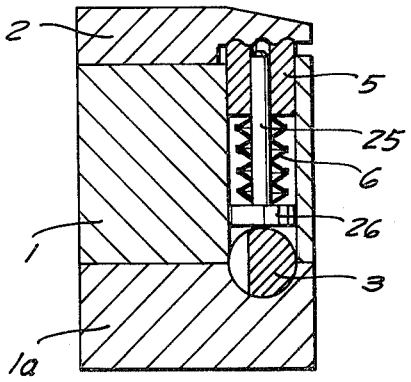
FIG. 12 is a section along the line G—G of FIG. 10 showing the device in the locked condition.
Figure 13:
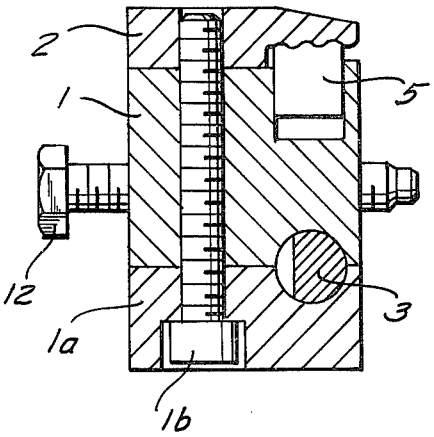
FIG. 13 is a section along the line H—H of FIG. 10, also in the locked state.

In the embodiment illustrated in FIGS. 9–14, the base is split into an upper base member 1 and a lower base member 1*a*. Bolts 1*b* secure the clamping bar 2 to the base member 1 as can be seen in FIGS. 10 and 13.

A plurality of base members and accompanying bases can be mounted in line along a common eccentric shaft 3 or a single unit spanning the entire width of the press plate can be provided. Adjusting screws are employed at 16 as previously described and the base can be mounted by brackets upon the guides 14 of the printing drum or cylinder 15.

As can be seen from FIGS. 11 and 12, the base 1 is provided with slots 23 which receive the clamping elements 5, these clamping elements being vertically displaceable relative to the base 1 and to the fixed jaw 29 formed by the overhanging clamping bar 2. Pins 25 extending to the clamping elements 5 from below are vertically shiftable in these clamping elements with slight friction.

The free ends of the pins 25 are formed with flanges 26 or bear against plates of similar construction which form seats for the spring 6, constituted as a stack of belleville washers in the manner described in connection with FIGS. 1–8. The springs 6 press the flanges 26 against the eccentric shaft 3. At their upper ends, each spring 6 bears upon the underside of the respective clamping element 5.

Figure 14:
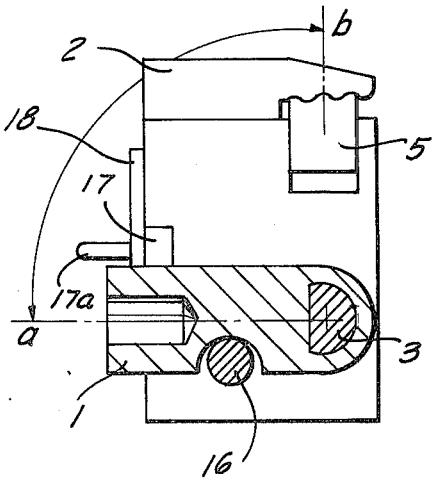
FIG. 14 is a section along the line J—J of FIG. 10.

The arrangement of FIGS. 9–14 operates as follows:

In the position illustrated in FIG. 11, a gap is provided between the clamping members formed by the bar 2 and the elements 5 and into which the edge of a printing plate (not shown) can be inserted. When the lever 4 affixed to the eccentric shaft 3 is swung from its position b in the counterclockwise sense into the position a (FIG. 14), each of the pins 25 is urged upwardly to compress the respective springs 6 and thereby resiliently urge the clamping element 5 upwardly to lock the printing plate in place. The locked position is illustrated in FIGS. 12–14.

In the locked position, the elements 5 are spring-loaded to accommodate variations in the thickness of the printing plate.

During the locking movement, a slight relative movement of each pin 25 with respect to the clamping element 5 occurs under the control of the spring 6 and the frictional engagement of the pin within the clamping element.

To release the printing plate, the eccentric shaft 3 and the lever 4 are rotated in the clockwise direction (FIG. 14) to restore the device to the position shown in FIG. 11. The aforementioned gap is again formed and the printing plate can be readily withdrawn. Each of the elements 5 is biased downwardly by a restoring pin 28 (FIG. 11) protruding from the element 5 so that, upon rotation of the eccentric shaft 3 into its position b, the spring 27, which has previously been compressed by upward displacement of each element 5, is urged downwardly into its position shown in FIG. 11.

As can be seen from FIG. 14, a movable lock 17 with a lever 17*a* is provided for displacement in a recess of a plate 18 to retain the lever 4 in its locked position a. This prevents accidential rotation of the eccentric shaft 4 during the printing process.

The device of the invention provides an unusually simple and quick-acting engagement of printing plates with automatic pressure equalization over the entire length of the clamping arrangement, thereby ensuring secure engagement of the printing plate over the length of its entire clamped edge.

I claim:

1. A clamping arrangement for a printing plate on a printing machine, said clamping arrangement comprising:

an elongated base;

at least one clamping bar mounted on said base and formed with a first clamping surface;

a plurality of clamping elements spaced along said base and forming respective second clamping surfaces juxtaposed with said first clamping surface and movable relative to said base;

spring means bearing upon each of said clamping elements and yieldably biasing same for pressure equalization along an edge of a printing plate to be clamped between said first and second surfaces, said clamping bar constituting one member and said elements constituting another member of a pair of relatively movable members engaging said edge of said printing plate between them; and an eccentric shaft rotatable relatively to said base and extending therealong while being operatively connected to at least one of said member for displacing said one of said members relative to the other of said members between an engaged position wherein said printing plate is clamped between said first and second surfaces and a disengaged position wherein said plate is released, said recess having a depth dimensionsed such that said head lies flush with a surface of said base in one limiting position of the respective element and engages a wall of said recess in another limiting position thereof.

2. The clamping arrangement defined in claim 1 wherein said clamping bar is movable relative to said base and constitutes said one of said members, being displaceable by said eccentric shaft, said arrangement further comprising respective restoring springs between said base and said clamping bar for biasing same into a position wherein said first surface is spaced from said second surface.

3. The clamping arrangement defined in claim 1 wherein the said spring of each of said elements is seated against an annular flange of said base forming the respective wall and surrounding the respective bolt, each said spring bearing against said side of the respective element.

4. The clamping arrangement defined in claim 3 wherein each such spring is a stack is a stack of Belleville washers closely surrounding the shanks of the respective belt.

5. The clamping arrangement defined in claim 1 wherein said clamping bar forms said one of said members and is displaceable relative to said base by said eccentric shaft, said clamping bar and said base together defining a space receiving said shaft.

6. A clamping arrangement for a printing plate on a printing machine, said clamping arrangement comprising:

an elongated base;

at least one clamping bar mounted on said base and formed with a first clamping surface;

a plurality of clamping elements apaced along said base and forming respective second clamping surfaces juxtaposed with said first clamping surface and movable relative to said base;

spring means bearing upon each of said clamping elements and yieldably biasing same for pressure equalization along an edge of a printing plate to be clamped between said first and second surfaces, said clamping bar constituting one member and said elements constituting another member of a pair of relatively movable members engaging said edge of said printing plate between them, and an eccentric shaft rotatable relatively to said base and extending therealong while being operatively connected to at least one of said members for displacing said one of said members relative to the other of said members between an engaged postion wherein said printing plate is clamped between said first and second surfaces and a disengaged position wherein said plate is released, said clamping bar constitutes said one of said members and being displaceable by said eccentric shaft relative to said base, said clamping bar being guided on said base by bolts passing through openings formed in said clamping bar and threaded into said base, said bolts being surrounded by spacers received with play in said openings.

7. The clamping arrangement defined in claim 6 wherein said base comprises a plurality of base members longitudinally aligned along said eccentric shaft and each provided with a respective clamping-bar member, two such members forming a respective unit.

8. The clamping arrangement defined in claim 7, further comprising an actuating lever connected to said shaft and positioned between two such units.

9. The clamping arrangement defined in claim 6 wherein said opening has walls lying directly adjacent said spacer in extreme positions of said clamping bar.

10. The clamping arrangement defined in claim 6 wherein said clamping bar is fixed to said base by bolts.

11. The clamping arrangement defined in claim 10 wherein each of said elements slidably receives a respective pin extending away from said second surface and formed with a plate at a free end remote from said element, said free end of each pin being engaged by said eccentric shaft.

12. The clamping arrangement defined in claim 11 wherein each of said springs bears against the respective plate and a side of the respective element turned away from its said second surface.

13. The clamping arrangement defined in claim 12 wherein each of said springs is a stack of Belleville washers.

14. A clamping arrangement for a printing plate on a printing machine, said clamping arrangement comprising:

an elongated base;

at least one clamping bar mounted on said base and formed with a first clamping surface;

a plurality of clamping elements spaced along said base and forming respective second clamping surfaces juxtaposed with said first clamping surface and movable relative to said base;

spring means bearing upon each of said clamping elements and yieldably biasing same for pressure equalization along an edge of a printing plate to be clamped between said first and second surfaces, said clamping bar constituting one member and said elements constituting another member of a pair of relatively movable members engaging said edge of said printing plate between them; and an eccentric shaft rotatable relatively to said base and extending therealong while being operatively connected to at least one of said members for displacing said one of said members relative to the other of said members between an engaged position wherein said printing plate is clamped between said first and second surfaces and a disengaged position wherein said plate is released said clamping bar being fixed to said base by bolts, each of said elements slidably receiving a respective pin extending away from said second surface and formed with a plate at a free end remote from said element, said free end of each pin being engaged by said eccentric shaft, each of said springs bears against the respective plate and a side of the respective element turned away from its said second surface and constituted by a stack of Belleville washers, respective restoring springs acting on each of said elements and seated against said bar for urging said elements away from said bar.

15. The clamping arrangement defined in claim 14 wherein each of said elements is formed with a laterally projecting pin engaged by the resepective restoring spring.

* * * * *